US008307817B2

(12) United States Patent
Dorwarth et al.

(10) Patent No.: US 8,307,817 B2
(45) Date of Patent: Nov. 13, 2012

(54) GAS BURNER MODULE FOR A GAS COOKTOP, AND GAS COOKTOP

(75) Inventors: Ralf Dorwarth, Oberderdingen (DE); Wilfried Schilling, Kraichtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 12/874,628

(22) Filed: Sep. 2, 2010

(65) Prior Publication Data

US 2011/0056480 A1 Mar. 10, 2011

Related U.S. Application Data

(63) Continuation of application No. PCT/EP2009/001315, filed on Feb. 25, 2009.

(30) Foreign Application Priority Data

Mar. 7, 2008 (DE) ..... 10 2008 014 841

(51) Int. Cl.
*F24C 3/08* (2006.01)

(52) U.S. Cl. ..... 126/39 R; 126/39 E; 126/39 BA

(58) Field of Classification Search ..... 126/39 R, 126/39 E, 39 BA; 251/129.2, 129.06
See application file for complete search history.

(56) References Cited

U.S. PATENT DOCUMENTS

| | | | | |
|---|---|---|---|---|
| 3,414,219 | A * | 12/1968 | Siegel | 248/65 |
| 4,818,446 | A * | 4/1989 | Schreiber et al. | 261/122.2 |
| 4,993,670 | A * | 2/1991 | Tesar | 248/68.1 |
| 5,099,822 | A * | 3/1992 | Cramer et al. | 126/39 BA |
| 5,405,263 | A | 4/1995 | Gerdes et al. | |
| 6,132,205 | A | 10/2000 | Harneit | |
| 6,318,357 | B1 | 11/2001 | Muhle et al. | |
| 6,425,389 | B1 * | 7/2002 | Muhle | 126/39 R |
| 6,648,377 | B2 * | 11/2003 | Marandi | 285/197 |
| 6,997,202 | B2 * | 2/2006 | Olander | 137/2 |
| 7,173,221 | B2 * | 2/2007 | Lerner | 219/445.1 |
| 7,255,100 | B2 * | 8/2007 | Repper et al. | 126/39 BA |
| 7,954,422 | B2 * | 6/2011 | Nevarez et al. | 99/349 |
| 2002/0073985 | A1 * | 6/2002 | Leukhardt et al. | 126/39 E |
| 2003/0136395 | A1 | 7/2003 | Distaso | |
| 2004/0262555 | A1 * | 12/2004 | Eisengruber et al. | 251/129.06 |
| 2007/0125356 | A1 * | 6/2007 | Crnkovich | 126/39 BA |

FOREIGN PATENT DOCUMENTS

DE 1 915 097 10/1970

(Continued)

OTHER PUBLICATIONS

International Search Report from PCT/EP2009/001315 dated Sep. 30, 2010.

(Continued)

*Primary Examiner* — Alfred Basichas
(74) *Attorney, Agent, or Firm* — Alston & Bird LLP

(57) ABSTRACT

A gas burner module for a gas cooktop has a gas burner with an ignition and monitoring electrode, and also ignition and control electronics, a flame monitoring device and a gas valve. A burner foot in the form of a base is provided as a supporting element of the gas burner module. These parts of the gas burner module are combined to form a unit and are mechanically connected to one another in such a way that they form a constructional unit which can be handled independently.

12 Claims, 5 Drawing Sheets

FOREIGN PATENT DOCUMENTS

| | | | |
|---|---|---|---|
| DE | 196 46 959 | A1 | 5/1998 |
| DE | 199 49 600 | | 4/2001 |
| EP | 0 412 041 | | 2/1991 |
| EP | 0 926 437 | | 6/1999 |
| EP | 0 976 984 | A2 | 2/2000 |
| EP | 0976984 | A2 * | 2/2000 |
| FR | 2 472 724 | | 7/1981 |
| WO | WO 02/097 333 | | 12/2002 |
| WO | WO 2008/026031 | A2 | 3/2008 |

OTHER PUBLICATIONS

English Translation of the International Preliminary Report from PCT/EP2009/001315 dated Jan. 27, 2011.

Cerbe, et al.; *Grundlagen der Gastechnik* (*Fundamentals of Gas Technology*), 1992, 4th Edition; pp. 273-281, Carl Hanser Verlag, Munich, Germany.

Office Action Dated Jul. 19, 2011, German Application No. 10 2008 014 841.5.

* cited by examiner

GAS BURNER MODULE FOR A GAS COOKTOP, AND GAS COOKTOP

CROSS REFERENCE TO RELATED APPLICATIONS

This application is a continuation of PCT/EP2009/001315, filed Feb. 25, 2009, which in turn claims priority to DE 10 2008 014 841.5, filed on Mar. 7, 2008, the contents of both of which are incorporated by reference.

BACKGROUND

The invention relates to a gas burner module for a gas cooktop, and a gas cooktop having a plurality of such gas burner modules. Gas cooktops frequently have multiple gas burners, and each gas burner requires a supply of gas to function. Further, each gas burner must be individually controllable, as well as individually ignite gas when turned-on, and detect burning of the gas after it has been turned on. There is a need for a gas burner module that uses common components which facilitates assembly of a gas cooktop comprising said gas burner modules.

SUMMARY OF INVENTION

The invention is based on the problem of providing a gas burner module of the type mentioned in the introduction and also a gas cooktop of the type mentioned in the introduction, with which the problems of the prior art can be avoided and, in particular, a gas burner module which can be handled and produced in an advantageous manner can be provided.

This problem is solved in one embodiment by a gas burner module or a gas cooktop having the features as claimed herein. Advantageous and preferred refinements of the invention are the subject matter of the further claims and are explained in greater detail in the text which follows. The wording of the claims is incorporated by express reference in the content of this description. The contents of German priority application DE 102008014841.5 of 7 Mar. 2008 in the name of the same applicant is also incorporated by express reference in the content of the present application.

In one embodiment, provision is made for the gas burner module having a gas burner with an ignition and monitoring electrode, control electronics and ignition electronics. A flame monitoring means and a gas valve are also provided. According to one embodiment of the invention, these parts of the gas burner module, which are necessary for the functioning of said gas burner module, are combined to form a unit and are mechanically connected or fitted to one another. This unit is designed as a constructional unit such that it can be handled independently, that is to say, it can be incorporated into a gas cooktop, as it were, as a modular unit. Only a connection to a gas supply and an electrical connection have to be made. As a result, it is possible to configure and match the components for the gas burner module and the unit during production to ensure optimum interaction. Furthermore, the manufacturer of the unit or of the gas burner module can thus ensure that assembly is performed correctly and therefore also optimum functioning is ensured with a maximum level of operational reliability.

In another development of the invention, the gas burner module can have a gas connection which is directly flange-mounted thereon, and therefore can be connected to a gas pipe, for example a so-called gallery pipe, which runs in the gas cooktop. In this case, the gas connection can advantageously have a fastening clip or be provided with such a fastening clip. Said fastening clip can serve to establish a firm mechanical connection to the gas pipe, so that the gas connection on the gas pipe immutably comprises a secure, gas-tight connection. A fastening clip of this type can engage over the gas pipe, for example on both sides of the gas connection, for uniform, secure fastening.

In another embodiment of the invention, the gas connection for the gas pipe is provided on one side of a burner foot, with the burner foot forming, as it were, the base for the gas burner module. In this embodiment, the gas connection is formed in such a way that the gas pipe passes close by the burner foot, and therefore the gas connection, and is held against said burner foot or gas connection by the fastening clip. In this embodiment, the fastening clip can advantageously be fastened to the burner foot.

In a further refinement of the invention, a centering pipe can be provided on the gas connection. It can extend, in particular, from the gas connection or the burner foot into the gas pipe in the state in which it is fastened to said gas connection or burner foot. When the gas module is fitted to a gas pipe during assembly of the gas cooktop, provision can then be made for the connection between the burner foot and the gas pipe to be gas-tight. Therefore, a gas supply can pass from the gas pipe, via the centering pipe or the gas connection and then a corresponding line, to the gas valve of the gas burner module, it also being possible for the burner foot to form part of the gas supply in this case.

In yet another refinement of the invention, the control electronics can be designed to be connected to a controller of the gas cooktop and, primarily, to be actuated by said controller. To this end, the gas cooktop controller can have an operator control device with operator control elements or can be provided with such an operator control device, with the operator control elements serving as the known interface to a user. Furthermore, the control electronics of a gas burner module can be designed to be connected to and interact with further gas burner modules of the same gas cooktop or with the control electronics of said further gas burner modules which are advantageously all identical. This can advantageously be performed using an internal bus system with corresponding cabling between the gas burner modules and the gas cooktop controller. Furthermore, a power supply unit including a power supply can be provided, the operator control device being connected to said power supply unit. The actuating means for the ignition and monitoring electrode is preferably integrated in the control electronics.

The gas valve can advantageously be a proportional valve. It can have a drive which is piezoelectric, magnetic or electromotive. In particular, the gas valve can be operated using a piezo bending beam, specifically generally in accordance with control commands which a user has pre-specified using the above mentioned operator control device using the operator control elements of said operator control device.

The abovementioned burner foot can be formed in the manner of a base. It can either carry the gas burner module or said gas burner module can be formed on said burner foot, and said burner foot can also contain the gas valve. The gas valve can therefore be integrated in the burner foot, it preferably being incorporated in the burner foot in a gas-tight manner as an insert. A line for the gas from the gas connection, which is connected to the gas pipe, to the gas valve can be formed either using an integrally projecting short line piece which is provided on the gas connection itself or by using an integrally projecting short line piece which is provided on the gas valve.

In another embodiment of the invention, a residual heat indicator can be provided on the gas burner module. To this end, a temperature sensor can be provided, said temperature sensor being mounted on the gas burner module, advantageously close to the gas burner, in order to detect the residual heat. It can even extend as far as a pot which is positioned on the gas burner. Furthermore, a pot detector can be provided, either in the same way as is known with inductive pot detection or even with mechanical pot detection, for example, by using a weight loading on a support on which a pot is placed. Further options are optical scanning from below to check whether there is a pot present over the gas burner.

In the case of a gas cooktop according to the embodiment of invention which has already been described above, a single gas pipe or gallery pipe can advantageously be provided. Said pipe can be formed in a peripheral manner in such a way that it passes by the outside of gas burner modules which are arranged flat. Therefore, all the gas burner modules can be supplied with gas. A course for the gas pipe close to the outer periphery of the gas cooktop has the advantage that it can be bent with relatively large radii, this simplifying production and processing thereof. Furthermore, in the case of a gas cooktop with, for example, four distributed gas burner modules, a central area which is produced can be filled with a fifth gas burner module, to which a free end of the gas pipe is routed for supplying gas, or control units or a power supply unit.

An operator control device, in particular as a unit or module with an above-mentioned gas cooktop controller, is advantageously likewise provided adjacent to an outer edge of the gas cooktop. The operator control device can also have a power supply unit and a main valve for the gas pipe which can disconnect all the gas burner modules from a gas supply. As an alternative embodiment, the power supply unit and the main valve control means for the main valve can be formed as an assembly which is separate from the pure operator control device, and can be arranged relatively freely and as close as possible to that end of the gas pipe which is provided on the outside in relation to the gas connection.

These and further features are described not only in the claims, but also in the description and the drawings, it being possible for the individual features to each be implemented in their own right or in groups in the form of sub-combinations for an embodiment of the invention and in other fields, and to represent advantageous embodiments, worthy of protection in their own right, for which protection is claimed here. The subdivision of the application into individual sections and the intermediate headings do not restrict the generality of the statements made therein.

BRIEF DESCRIPTION OF THE DRAWINGS

An exemplary embodiment of the invention is schematically illustrated in the drawings and will be explained in greater detail in the text which follows. In the drawings.

DETAILED DESCRIPTION

Figure 1:
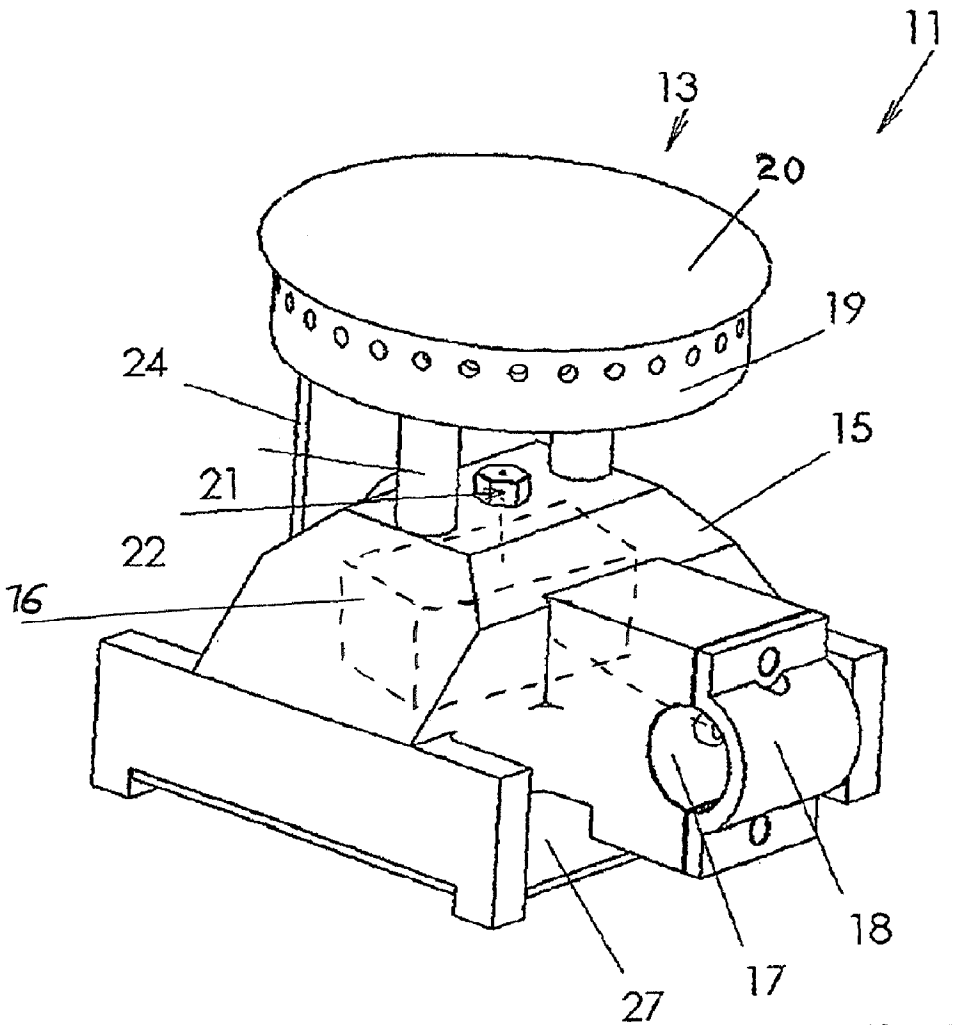
FIGS. 1 and 2 illustrate two different oblique views of a gas burner module according to one embodiment the invention from above.
Figure 2:
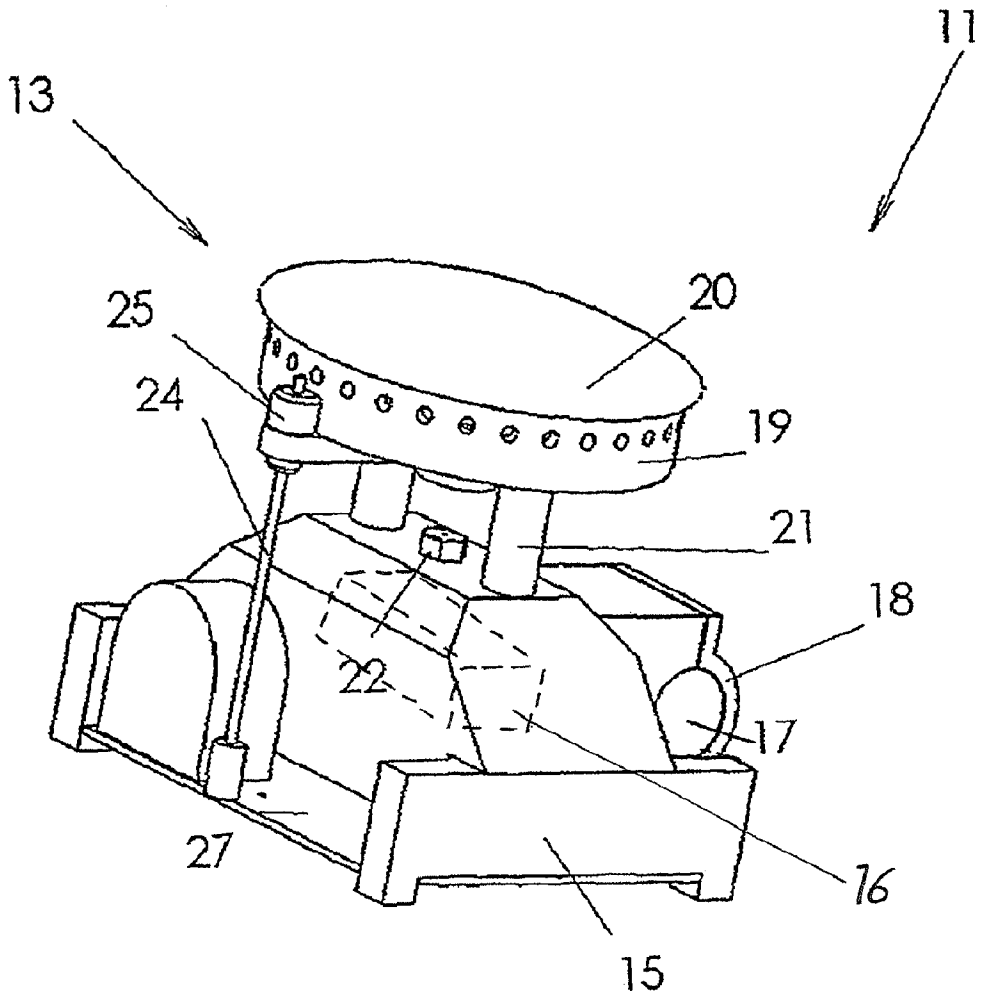

FIGS. 1 and 2 are oblique illustrations of a fully assembled gas burner module 11. It has a gas burner 13 which sits on a burner foot 15, and therefore the burner foot 15 forms a kind of base. A gas connection 17 is provided, said gas connection having a fastening clip 18 which can be removed and screw-mounted, said gas connection and fastening clip forming a cylindrical passage.

The gas burner 13 comprises a burner pot 19 and a burner cover 20, as are known per se from the prior art. A nozzle 22 for the volumetric flow of gas in the gas burner 13 is located beneath said burner pot and burner cover on the burner foot 15. To this end, there is a gas valve 16 beneath the nozzle 22, as is described in detail in the introduction. Gas flows with excess pressure from the nozzle 22 into the burner pot 19 from below and exits at lateral bores and is burnt together with the combustion air as a flame. The burner cover 20 which can be held on a burner pot holder 21 in a removable manner and causes the gas stream to be deflected laterally through the bores in the burner pot 19 is provided at the top.

FIG. 2 shows that an ignition electrode 24 is provided on the gas burner module 11 on the other side of the gas connection 17. Said ignition electrode is fastened to the gas burner 13 or on the burner pot holder 21 by means of an insulating holder 25 and is formed such that it both fulfils the function of igniting the gas or mixture and also monitors the flame at the same time. To this end, said ignition electrode can have a high-voltage spark ignition means for the ignition. An ionization flame monitoring means can be used to monitor flames. In alternative embodiments, ignition can be performed by means of a glowing element and flame monitoring can be performed using a thermocouple. A controller 27 is provided on the lower face of the gas burner module 11 or of the burner foot 15.

Figure 3:
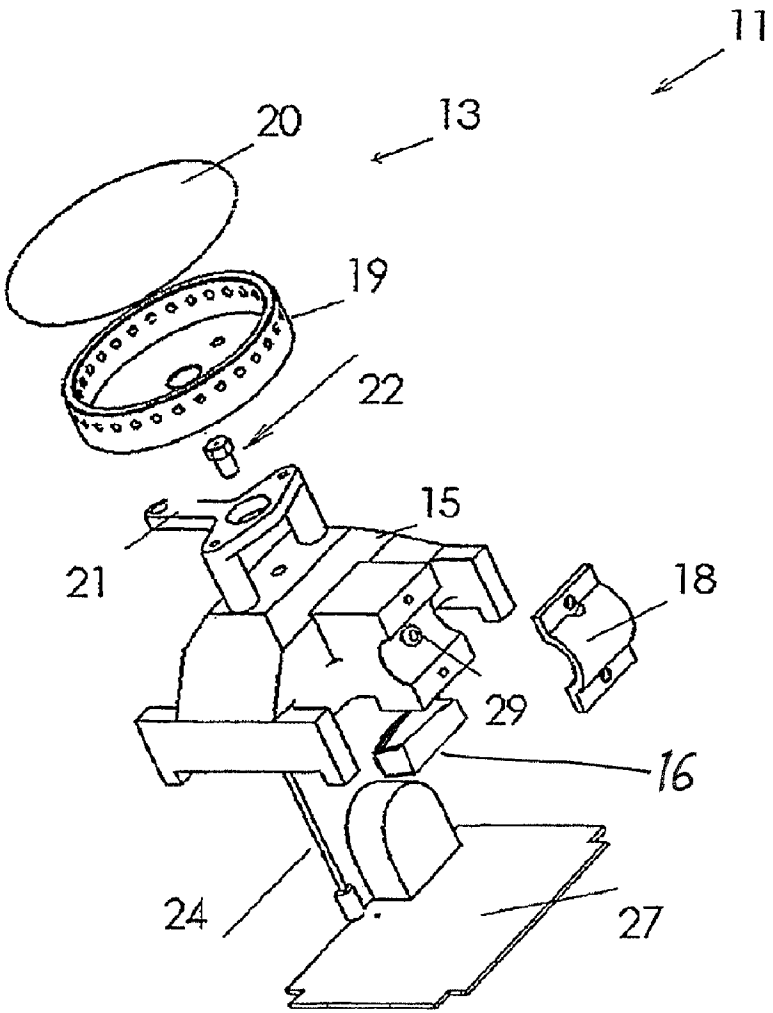
FIGS. 3 and 4 illustrate exploded oblique views of the gas burner module according to FIG. 1.
Figure 4:
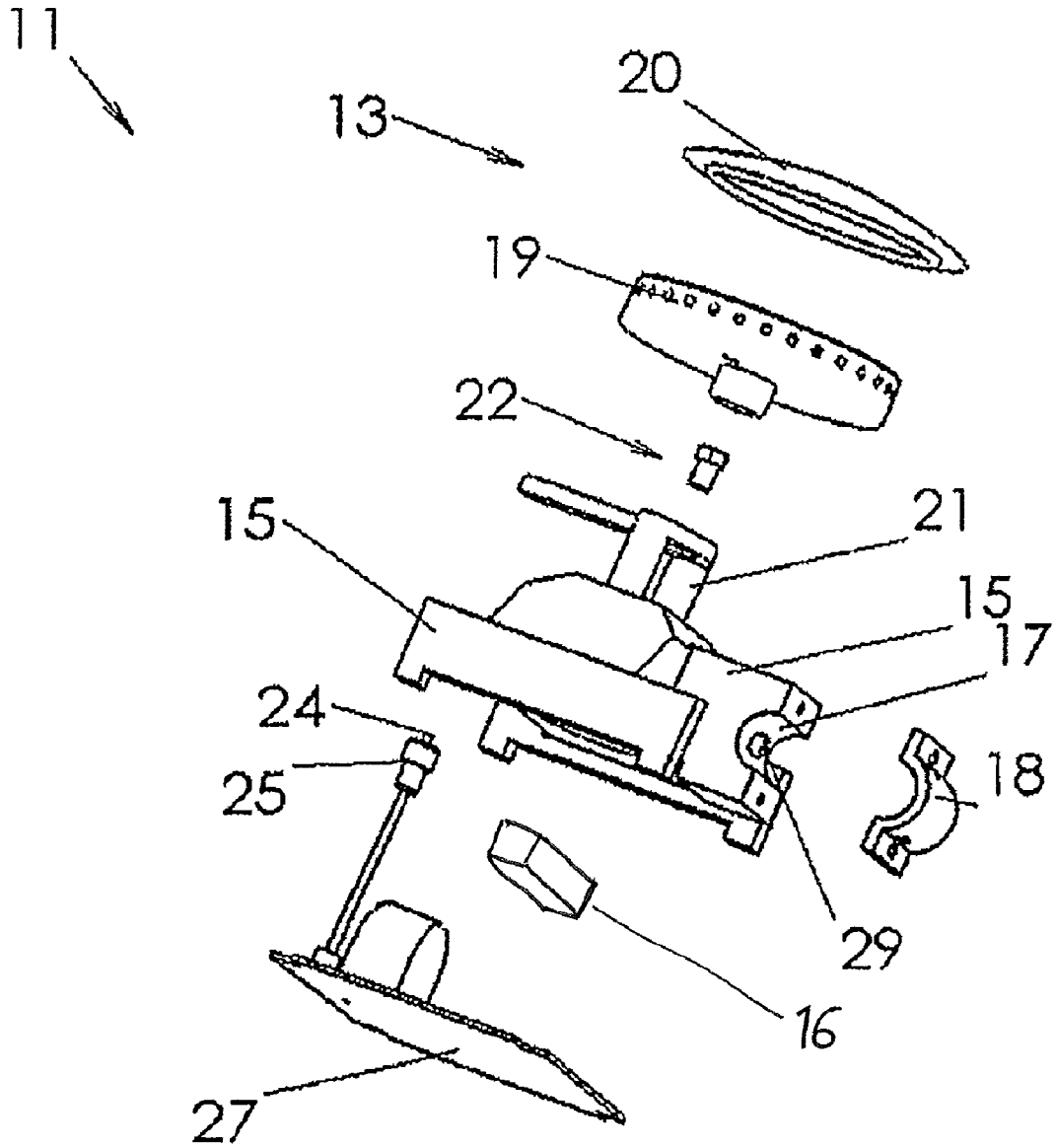

FIGS. 3 and 4 show exploded illustrations of how the gas burner module 11 is mounted. They also show how the burner pot 19 is positioned on the burner pot holder 21. Furthermore, these illustrations show the centering pipe 29 on the gas connection 17, a connection to a gas pipe being established by means of said centering pipe and gas connection. In a similar way, a twin-circuit gas burner can also be formed, specifically as a complete gas burner module. Gas burners which are formed correspondingly differently are to be provided in this case, as are two nozzles and gas valves integrated in the burner foot. An ignition electrode is sufficient.

Figure 5:
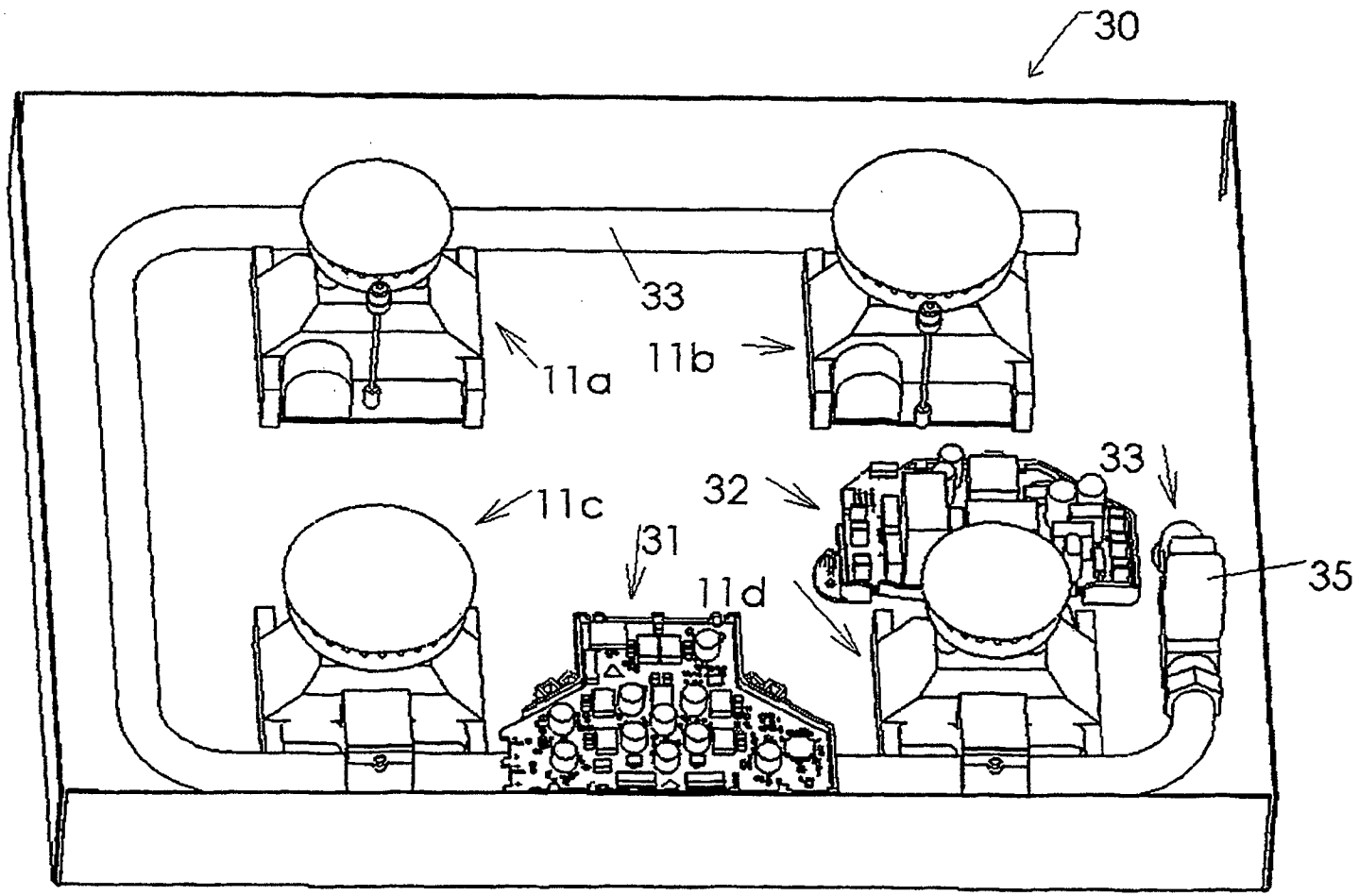
FIG. 5 illustrates a gas cooktop with four gas burner modules.

FIG. 5 shows a gas cooktop 30. It has four gas burner modules 11*a*-11*d* in an arrangement with customary distribution. The gas cooktop 30 has a gas cooktop controller 31 in the front region. This gas cooktop controller 31 can correspond to a conventional control means for a conventional cooktop, for example with a cover and touch switches as operator control elements, in particular with capacitive sensor elements. Furthermore, a power supply unit 32 is illustrated in the right-hand region separately from the gas cooktop controller 31. It also has the main valve control means for the main valve 35.

A gallery pipe 33 runs along with, or adjacent to, the outer edge of the gas cooktop 30 and in this way leads to all the gas burner modules 11*a*-11*d*. In addition, said gallery pipe has, in front of its connection to the first gas burner module 11*d*, a main valve 35 which is connected to the main valve control means on the power supply unit 32. This main valve 35 can be electronically actuated and ensures that the gallery pipe 33 and therefore the gas supply are, as it were, shut off if the gas cooktop 30 is switched off.

It is clear how the gas burner modules 11*c* and 11*d* are connected to the gallery pipe 33 by means of the respective gas connections 17 and the fastening clips 18. In this case, the above-described centering pipes 29 extend through the corresponding openings into the gallery pipe 33, with this connection being sealed off (gas tight).

The control means 27 has the electronic components for ignition, ignition monitoring, gas valve control and communication with a superordinate control means or operator control device 31. To this end, said control means can have at least one microcontroller, advantageously with class C software. The operator control part, the main valve control means and the gas burner modules 11 communicate by means of a bus connection which is designed to be failsafe. A LIN based protocol is preferably used for this purpose. In order to increase reliability, an additional electrical line is provided between the gas burner modules 11 and the main valve control means 32, the main valve being supplied with power via said additional electrical line. The main valve can be disconnected from each heating element by series connection of a switching element for each gas burner module.

Power is supplied to the gas burner modules 11 and the gas cooktop control means 31 via the power supply unit 32. The lines required for this purpose are integrated in a bus plug (not illustrated).

The gas burner modules 11 are designed such that they can be configured. Various parameters can be programmed via a wire-bound or wireless interface. The parameters include, for example, the geometric position within the gas cooktop 30, the rated power of the gas burner module 11, the type of gas, and the valve characteristics.

Both the illustration of a single gas burner module 11 and the illustration of an entire gas cooktop 30 according to FIG. 5 show that a gas cooktop can be designed relatively easily together with a great degree of variability by providing gas burner modules 11 which are prefabricated in the modular manner. Specifically, it is necessary to fasten only one gas burner module 11 to the cooktop 30 and then to connect it to a gas supply by means of the gallery pipe 33 and to provide a control line including an electrical connection to the gas cooktop control means 31. As a result, a highly variable design of a gas cooktop 30 is possible, primarily without fault sources during assembly, as long as the connection to the gallery pipe 33 is made correctly. It can also be seen that the burner pot 19 and the burner cover 20 are larger in the case of gas burner modules 11*b* and 11*c*. This means that they are designed for higher powers and therefore also generate a higher heating power as a result of the combustion of more gas.

The invention claimed is:

1. A gas burner module for a gas cooktop, comprising:

a gas burner comprising an ignition and monitoring electrode;

control electronics;

ignition electronics;

a flame monitoring means;

a gas valve; and a burner foot, wherein said burner foot is in the form of a base provided as a supporting element of said gas burner module, wherein said gas burner, said control electronics, said ignition electronics, said flame monitoring means, said gas value, and said burner foot are mechanically combined to form an independent unit, wherein said gas valve is integrated in said burner foot, wherein said burner foot comprises a nozzle configured to facilitate volumetric flow of gas in the gas burner, the nozzle located beneath a burner pot and a burner cover of the gas burner, and wherein the gas valve is located beneath the nozzle in the burner foot and the nozzle is configured to apply pressure to enable gas flow from the nozzle into the burner pot, of the gas burner, from below and exiting at lateral bores and is burnt together with the combustion air as a flame.

2. The gas burner module according to claim 1, wherein said gas valve is a proportional valve.

3. The gas burner module according to claim 1, wherein said gas valve is incorporated in said burner foot in a gas-tight manner, wherein said burner foot is part of said gas valve and forms a housing for said gas valve.

4. The gas burner module according to claim 1, wherein said control electronics are designed for connection to a gas cooktop controller.

5. The gas burner module according to claim 4, wherein said gas cooktop controller comprises an operator control device with operator control elements forming the interface to a user.

6. The gas burner module according to claim 4, wherein said control electronics are configured to connect to a further gas burner module.

7. The gas burner module according to claim 1, comprising a gas connection for direct flange-mounting on a gas pipe.

8. The gas burner module according to claim 7, wherein said gas connection is provided with a fastening clip disposed over said gas pipe thereby providing mechanical connection of said gas burner module with said gas pipe.

9. The gas burner module according to claim 8, wherein said gas connection for said gas pipe is formed so as to project laterally from one side of said burner foot such that said gas pipe passes adjacent to said burner foot and is held against said burner foot by said fastening clip.

10. The gas burner module according to claim 7, wherein a centering pipe extends from said burner foot into said gas pipe forming a gas-tight connection between said burner foot and said gas pipe.

11. A gas cooktop comprising:

at least one operator control device with operator control elements as an interface to a user;

a gas pipe; and a plurality of gas burner modules wherein each gas burner module comprises a gas burner comprising an ignition and monitoring electrode, control electronics, ignition electronics, a flame monitoring means, a gas valve, and a burner foot in the form of a base provided as a supporting element of said gas burner module, wherein said gas burner, said control electronics, said ignition electronics, said flame monitoring means, said gas value, and said burner foot are combined to form a mechanically connected constructional unit, and wherein said plurality of gas burner modules are each connected to said gas pipe, and wherein said gas valve is integrated in said burner foot, wherein said burner foot comprises a nozzle configured to facilitate volumetric flow of gas in the gas burner, the nozzle located beneath a burner pot and a burner cover of the gas burner, and wherein the gas valve is located beneath the nozzle in the burner foot and the nozzle is configured to apply pressure to enable gas flow from the nozzle into the burner pot, of the gas burner, from below and exiting at lateral bores and is burnt together with the combustion air as a flame.

12. The gas cooktop according to claim 11, wherein said gas pipe runs along adjacent to a lateral outer periphery of said gas cooktop and said operator control device is arranged adjacent to an outer edge.

* * * * *